United States Patent [19]

Brownlee

[11] 3,999,735

[45] Dec. 28, 1976

[54] CONCRETE POURING FORMS FOR UNITING BUILDING UNITS

[76] Inventor: Robert O. Brownlee, 353 McDonald Ave., Mobile, Ala. 36604

[22] Filed: Apr. 2, 1975

[21] Appl. No.: 564,362

Related U.S. Application Data

[62] Division of Ser. No. 394,771, Sept. 6, 1973.

[52] U.S. Cl. ..... 249/19; 249/219 R; 249/95; 249/192; 249/194

[51] Int. Cl.[2] ..... E04G 11/00

[58] Field of Search ..... 249/1, 13, 18, 19, 23, 249/26, 27, 48, 49, 83, 95, 143, 87 R, 188, 189, 191, 194, 205, 207, 219 R

[56] References Cited

UNITED STATES PATENTS

| | | | |
|---|---|---|---|
| 677,649 | 7/1901 | Farrell | 249/219 R X |
| 875,219 | 12/1907 | Scammell | 249/219 R X |
| 901,209 | 10/1908 | Sullivan | 249/48 X |
| 920,787 | 5/1909 | Sullivan | 249/219 R X |
| 965,358 | 7/1910 | Aybett | 249/1 |
| 1,171,734 | 2/1916 | McArthur | 249/194 |
| 1,779,908 | 10/1930 | Grajiano | 249/192 X |
| 1,947,413 | 2/1934 | Hay | 249/48 X |
| 2,026,472 | 12/1935 | Hromek | 249/219 R X |
| 2,093,346 | 9/1937 | Bodt | 249/48 X |
| 2,448,883 | 9/1948 | Hall | 249/48 X |
| 2,691,996 | 10/1954 | McNair | 249/219 R X |
| 2,713,190 | 7/1955 | Reitter | 249/95 X |
| 2,741,821 | 4/1956 | Findley | 249/219 R X |
| 2,831,231 | 4/1958 | Toensing | 249/48 |
| 3,066,962 | 12/1962 | Koehler | 249/219 R X |
| 3,429,548 | 2/1969 | Taylor | 249/192 |

*Primary Examiner*—J. Howard Flint, Jr.
*Attorney, Agent, or Firm*—Burns, Doane, Swecker & Mathis

[57] ABSTRACT

A concrete pouring form for use in permanently joining at the job site precast reinforced or prestressed posts and beams. The posts and beams are precast and will be used in the erection of the building when they have reached their maximum strength. Only sufficient concrete will be poured at the job site, as needed, to interconnect the posts and beams and perhaps the floors. Forms are used for joining together the adjacent ends of the posts and beams and providing therebetween a cavity into which concrete can be poured. The forms are preferably sectional so as to be separated and removed after the amount of concrete poured at the jobsite has set fully. These forms have clips thereon which can be connected with suitable guy supports for stabilizing the joint during the setting of the poured concrete therein.

5 Claims, 14 Drawing Figures

FIG. 1
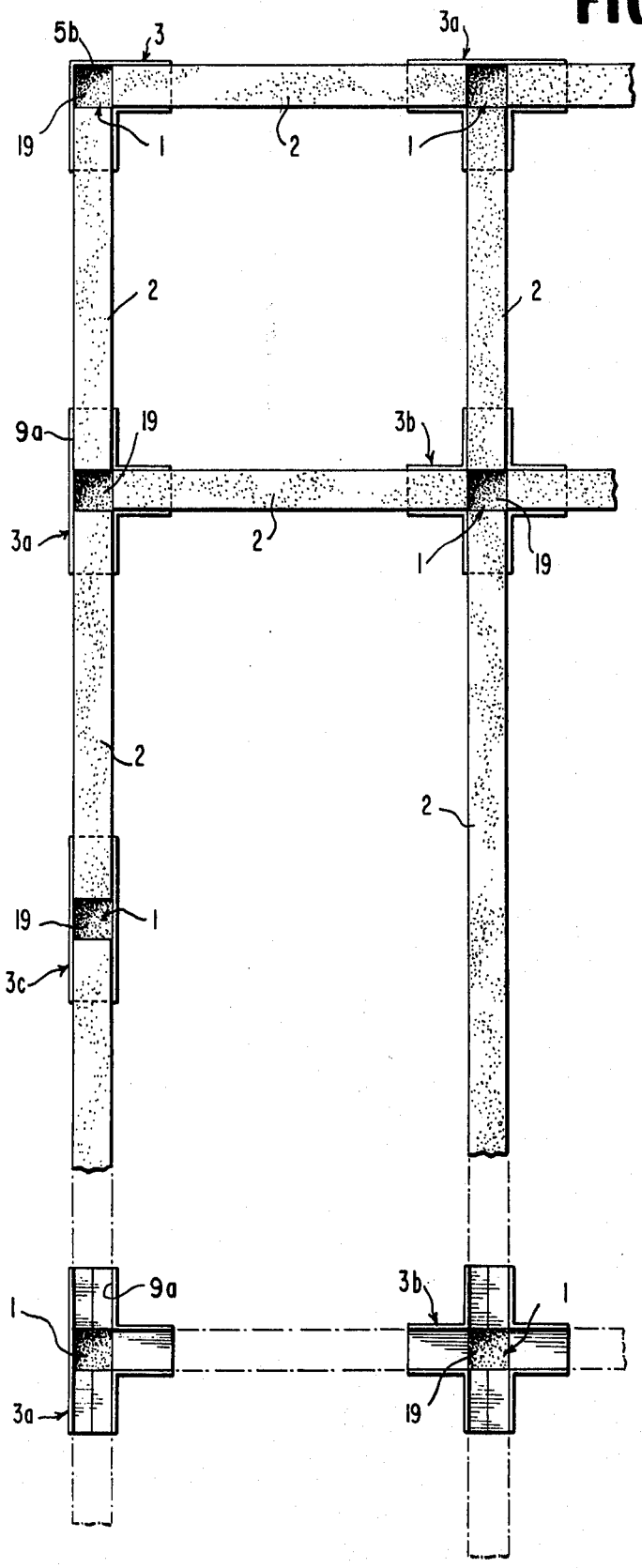
FIG. 2
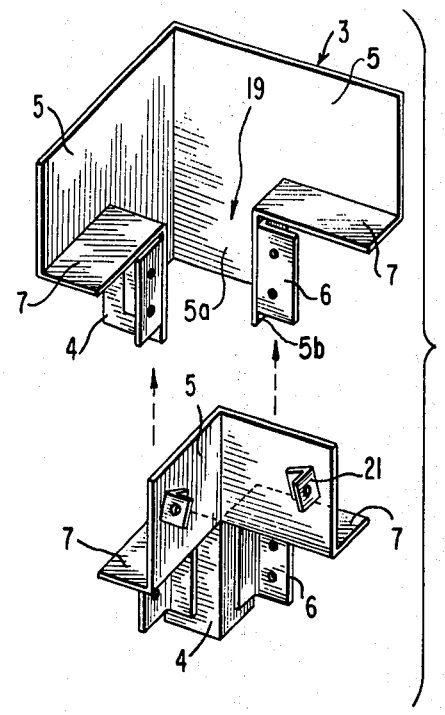
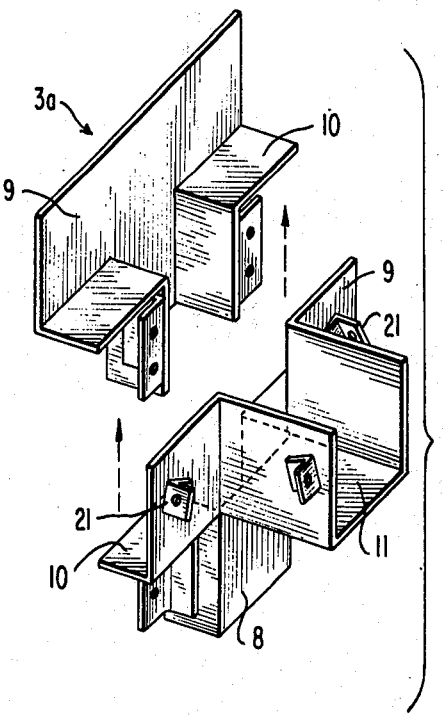
FIG. 3

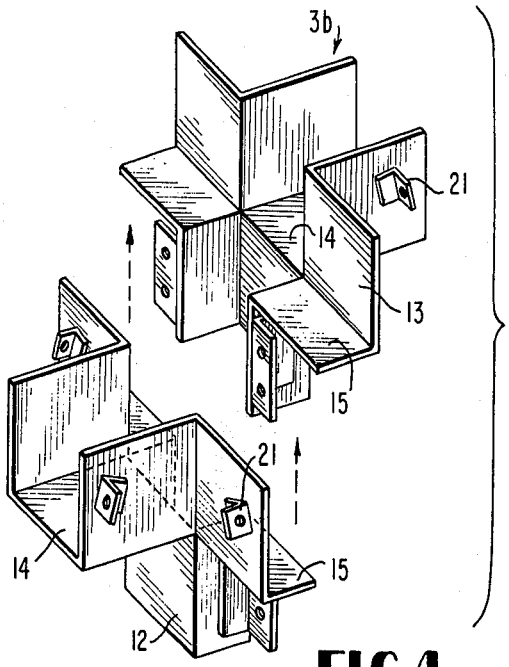
FIG. 4
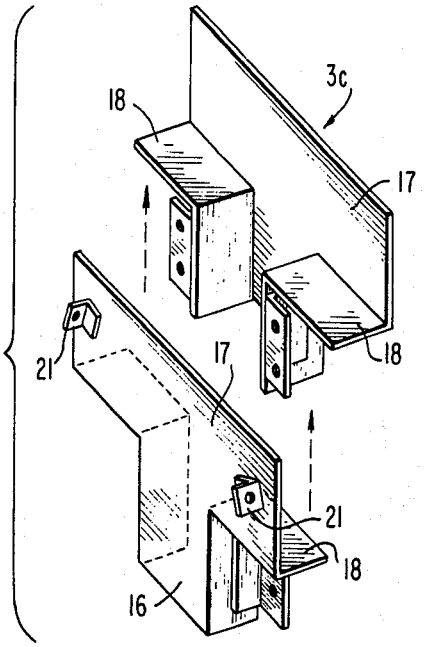
FIG. 5
FIG. 6
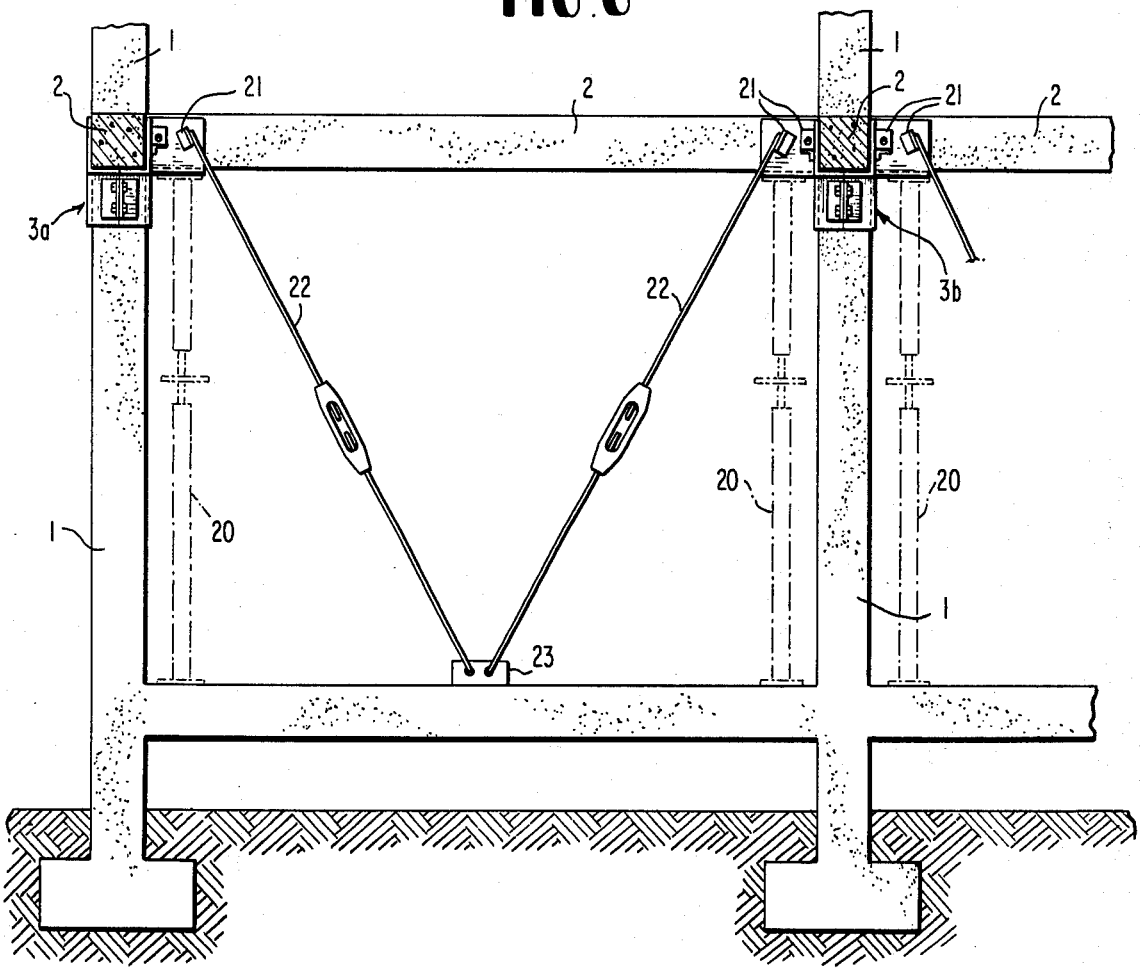

FIG. 7
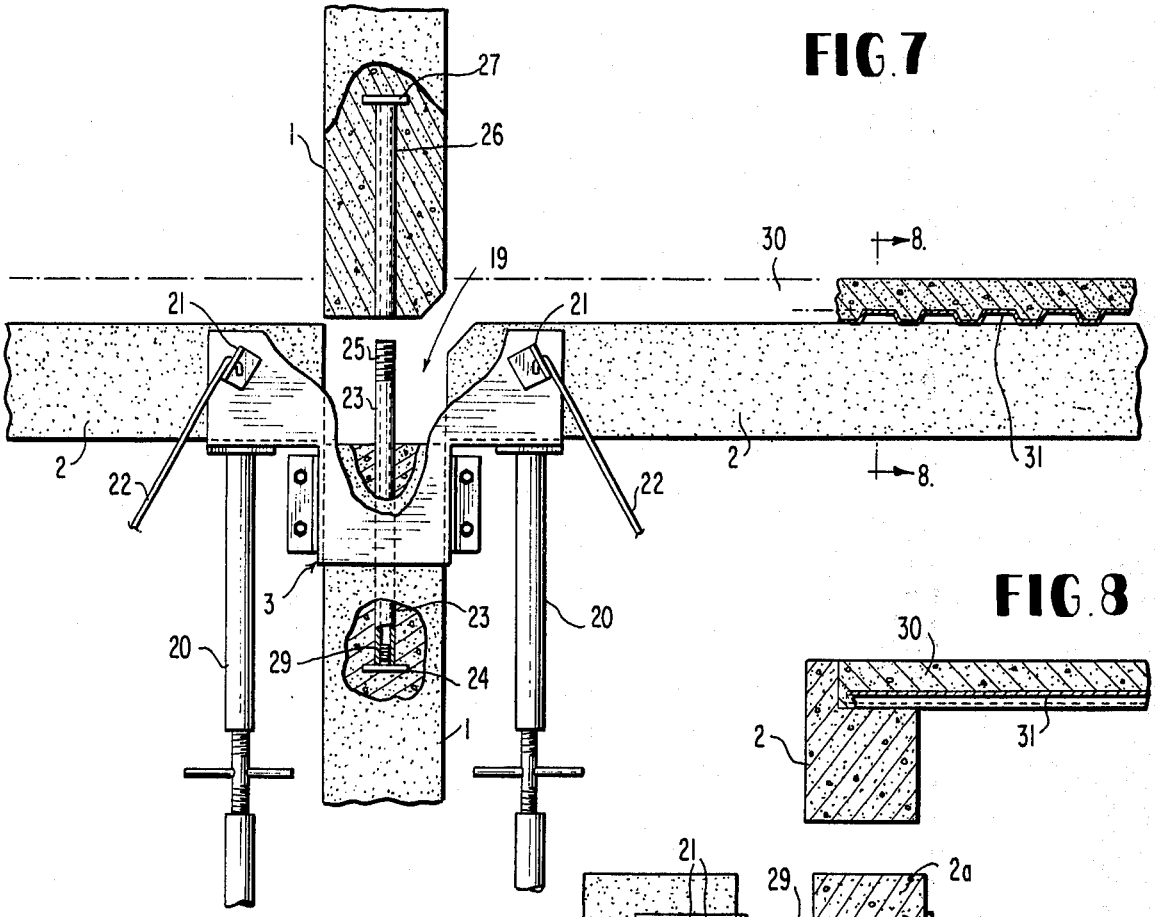
FIG. 8
FIG. 11
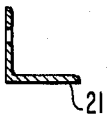
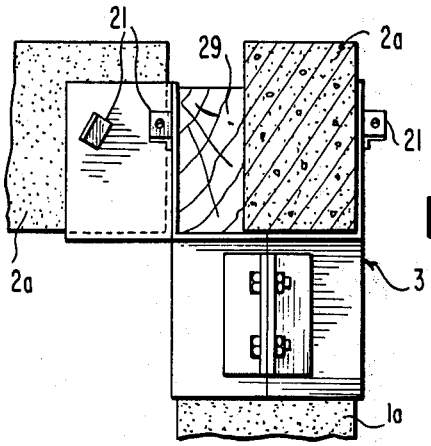
FIG. 10
FIG. 9
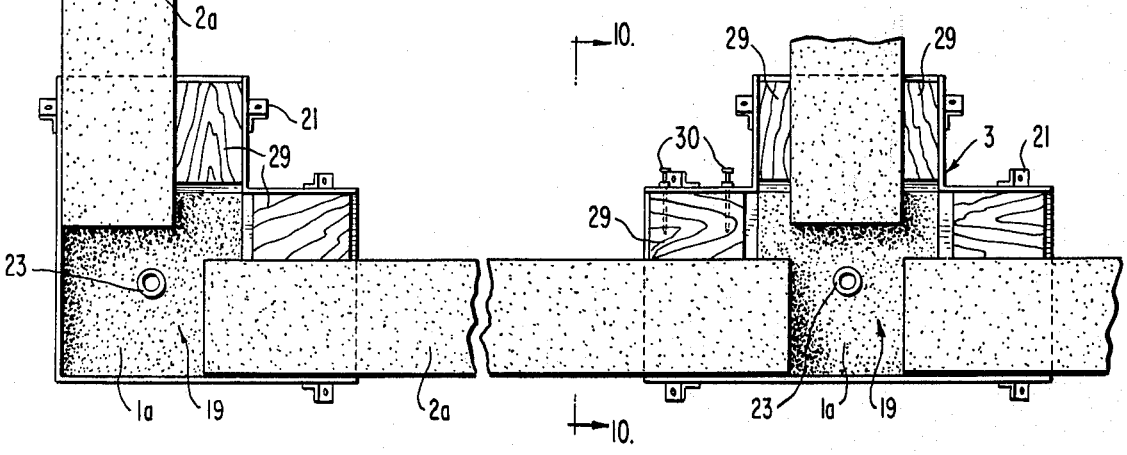

CONCRETE POURING FORMS FOR UNITING BUILDING UNITS

This is a division, of application Ser. No. 394,771, filed Sept. 6, 1973.

SUMMARY OF THE INVENTION

This invention relates to farms for use in Erecting a Building Construction, for example, of concrete.

Many buildings are formed of concrete poured at the job site to provide the needed posts and beams. This requires multiple forms at the job site and also a substantial delay in the erection of the building inasmuch as the large amount of concrete being poured must be allowed to set to a predetermined extent before additional columns and beams can be supported thereon. No satisfactory method has been proposed heretofore for utilizing preformed posts and beams.

The object of the invention is to improve the construction of concrete forms to enable these to be applied to preformed posts and beams so as to join them together effectively for the pouring of concrete into the cavity therebetween and to stabilize this connection during the setting of the small amount of concrete used for this purpose.

These objects may be accomplished, according to certain embodiments of the invention, by utilizing preformed concrete posts and beams that may be erected at the job site, with their ends joined together by concrete forms that provide for a cavity between the connected portions into which a small amount of concrete is poured for joining these ends effectively. The concrete forms are reusable, preferably being made in sections that may be connected together about the posts and beams and then removed after setting of the concrete poured at the jobsite. It is also preferably that the forms be provided with clips thereon to which guy supports may be connected for stabilizing the joint during the setting of the connecting concrete.

BRIEF DESCRIPTION OF DRAWINGS

Certain embodiments of the invention are illustrated in the accompanying drawings, in which:

FIG. 1 is a top plan view of a portion of the framework of a building erected in accordance with this invention;

FIG. 2 is a disassembled perspective view of one type of concrete form that may be used as a corner connection;

FIG 3 is a similar view of a Tee connection;

FIG. 4 is a similar view, showing another type of cross section;

FIG. 5 is a similar view, showing a running joint;

FIG. 6 is a side elevation, showing the guy supports connected to the concrete forms that join the posts and beams together;

FIG. 7 is a detailed side elevation, partly in section, showing a joint in course of being filled;

FIG. 8 is a cross section therethrough on the line 8—8 in FIG. 7;

FIG. 9 is a top plan view of posts and beams, showing a modification of the connection therebetween;

FIG. 10 is a cross section therethrough on the line 10—10 in FIG. 9;

FIG. 11 is a detailed cross section through one of the clip angles;

DETAILED DESCRIPTION OF DISCLOSURE

Figure 12:
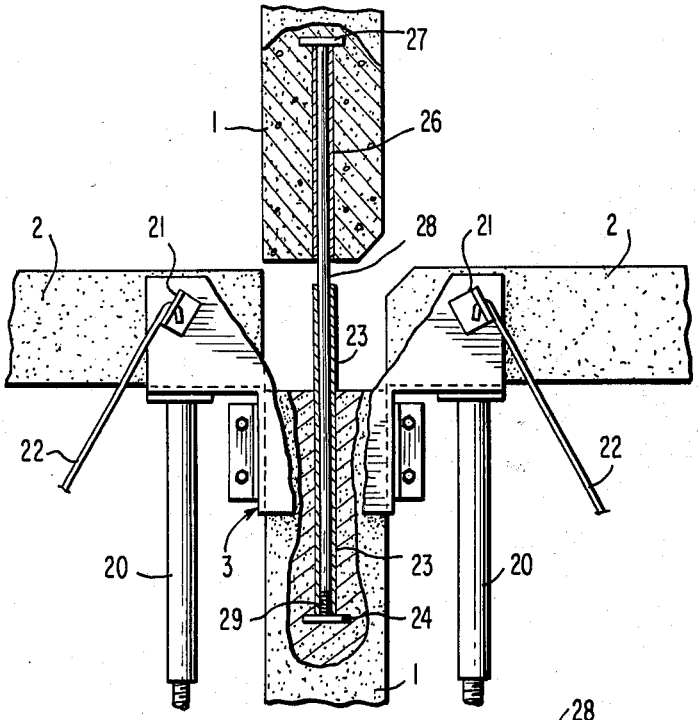
FIG. 12 is a view similar to FIG. 7, but showing the supporting rod in place.

The invention is shown in connection with the erection of a concrete building which has a series of posts, generally designated by the numeral 1, upon which beams 2 are adapted to be mounted for secure connection therewith. These parts are shown as assembled on a suitable foundation, according to FIG. 6, which foundation will be of whatever character may be found desirable by the architect.

The post and one or more connected beams are brought together at suitable angles at each joint therebetween and are connected by means of a concrete form, generally indicated at 3, and which is shown in place in FIGS. 1, 6 and 7. Several illustrative examples thereof are shown more in detail in FIGS. 2 to 5.

FIG. 2 shows a corner connection made in two parts, each of which has a skirt section 4 depending from an upper wall section 5 which has a lower wall section **5*a* forming a wall of the skirt section 4. These parts are adapted to be fitted together, and each of the skirt sections 4 has outturned flanged 6 thereon in positions for mating relation with the complementary section to form an upright sleeve 5*b*, the opposed flanges having suitable fastening bolts 6*a* extending for securing the mold 3 about the upright post 1. The wall section 5 includes flanges 7 forming shelf supports for the beam or beams 2** to be connected therewith.

A Tee connection is provided by a concrete mold **3*a*, an example of which is illustrated in FIG. 3. The mold form 3*a* also has a depending skirt 8 and opposite wall sections 9, having shelf supports 10 therebetween and cooperating with the wall section 9 to form a horizontal sleeve 9*a*, for aligning and holding the ends of the beams in proper relation to the upright post 1 while the connecting concrete in the cavity provided therebetween sets and hardens. A second horizontal sleeve is shown at 11 on one skirt section 8** for supporting the Tee beam at an angle to the aligned beams.

Another concrete form is illustrated at **3*b* and shown in FIG. 4 for joining together the cross sections of beams. This also is made sectional and connected together, as described above in connection FIG. 2. The mold form 3*b* has skirt and wall sections 12 and 13 arranged to be connected respectively with the adjacent ends of the post 1 and beams 2, extending into complementary parts of horizontal sleeves formed between the sections thereof, as indicated at 14 and 15**, respectively.

Still another type of concrete form is illustrated at **3*c* in FIG. 5, adapted to make a running joint between aligned ends of beams and to be connected with an upright post therebetweeen. This concrete form 3*c* is also made in two sections, with a depending skirt 16 and parallel side walls 17, the latter having shelf supports 18** for holding in place the adjacent ends of the aligned beams.

Each of these concrete forms, as shown, is made in two sections, with the sections fitting in complementary relation being detachably connected together by flanges thereon, as described above in connection with FIG. 2, for holding the skirt portion of the concrete form about the upright end of the post 1 during the pouring of concrete into a cavity in the form, which is indicated generally at 19 in FIG. 2. The cavity is provided between the walls of the form above the upper end of the upright post 1 and between the aligned ends of the horizontal beams, as will be apparent from FIG. 7. When the parts are in place, the aligned ends of the horizontal beams may be stabilized by jacks 20 which abut the horizontal bottom face of the horizontal supports in the several concrete forms.

Each of the concrete forms is also provided with clip angles 21 to which guy connections 22 can be attached at one end. The opposite ends extending to suitable brackets, as indicated at 23 in FIG. 6, are connected with the foundation structure of the building or with any set concrete in a lower part of the building than the point of connection being formed. The clip angle 21 is illustrated in detail in FIG. 11. This is formed preferably of an angle bar section or bent sheet metal angle, having a hole through one leg thereof, with the opposite leg welded or otherwise secured to one of the side walls of the mold form.

I have shown in FIGS. 7 and 12 the aligned ends of superposed posts 1 which are held in spaced relation with their ends in alignment with the upper and lower faces of concrete beams 2. These are shown as having the molding form 3 applied to the aligned ends of the upright post and beams.

The upper end of the lower post has a sleeve 23 molded therein, with a cap 24 on the lower end thereof. The upper end of the sleeve 23 projects into the cavity 19 between the aligned ends of the beams 2 to a point which is located preferably just below the upper edge of each of these beams as, for example, being spaced two inches below the upper edge and below the lower end of the superposed post 1. The upper end of the sleeve 23 is shown as screw threaded, as indicated at 25, for attachment of a lifting cap thereto to facilitate handling of the post and to draw it into proper position when desired.

The upper post 1 is provided with a sleeve 26 in the lower end portion thereof, with a pipe cap 27 closing the upper end of the sleeve 26 and embedded in the concrete post. The lower end of the sleeve 26 is substantially flush with the lower end of the post or column 1 and should be located in vertical alignment with the sleeve 23 in the lowermost post or column. The aligned ends of the sleeves 23 and 26 are open to receive a support rod 28 which may be cut to the proper length so as to abut against the respective pipe caps 24 and 27 and thereby to hold the aligned ends of the posts or columns 1 spaced apart the proper distance to receive the concrete in the cavity 19.

If desired, shims may be dropped into the lower end of the sleeve 23, as indicated at 29 in FIG. 7, so as to support the rod 28 thereon and to properly position the aligned ends of the posts or columns.

When these parts are thus properly assembled, as illustrated in FIG. 7, concrete is poured into the cavity 19 in the mold form to fill this cavity and the parts remain in place during setting of this filling or connecting concrete. Then, the mold concrete form is removed from the joint by detaching the two sections thereof after removal of the jacks 20 and the guy connections 22.

If it be desired to provide a concrete floor over the beams, this may be poured, as indicated at 30 in FIG. 7, preferably being formed over suitable steel decking, generally indicated at 31.

The concrete forms 3 can be made of any suitable material and designed for attachment to posts and beams of any desired shape, as for example, square, rectangular or round members. These concrete forms may also be made of any suitable material, such as steel or other metals, alloys, plastic, wood or the like.

A modification is shown in FIGS. 9 and 10, wherein the posts 1*a* support beams 2*a* that are of the approximate size corresponding with those used in buildings up to six floors in height. For proper alignment and to maintain a smooth outer edge of the connection between the post and beam, wooden blocks are shown at 29 connected as by nails 30 to the forms 3, holes being provided in the latter at appropriate points for receiving the nails so that the blocks will compensate for variations in thickness between the beams and posts. Otherwise, the concrete forms 3, used according to this example, will be the same as have been described above.

Also as shown in FIG. 9, this illustrates a variation of architectural appearance and structure that may be provided for differences in the appearance of the face of the exterior beams while maintaining the flush relation thereof to the columns.

The ends of the beams 2 or 2*a* may extend flush with the walls of the posts 1 or 1*a* (FIG. 1) or overlap the latter, as illustrated in FIG. 9.

Figure 13:
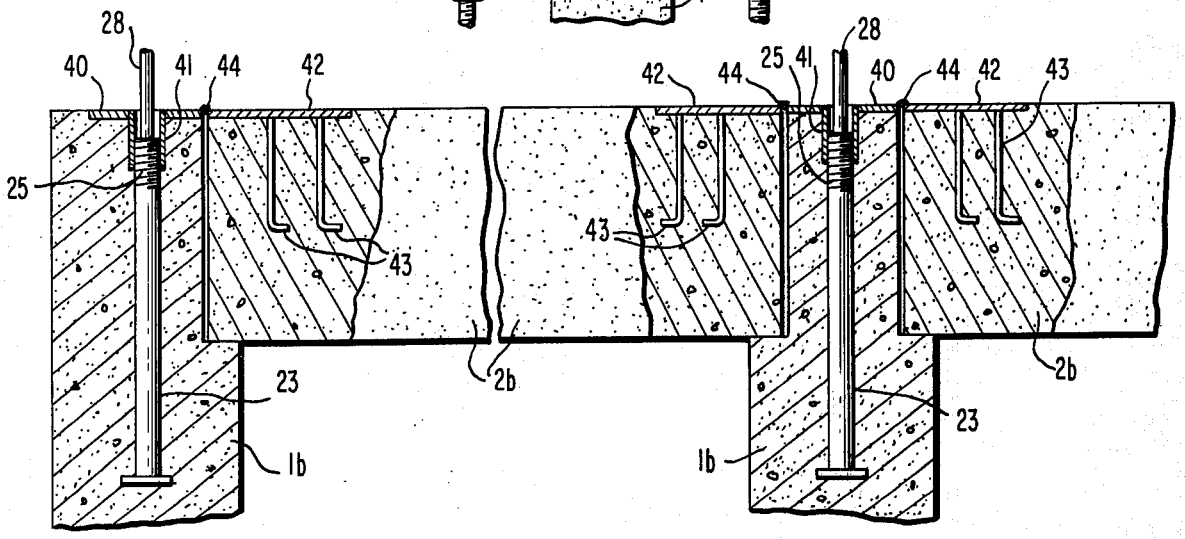
FIG. 13 is a side elevation, partly in section, showing another modification.
Figure 14:
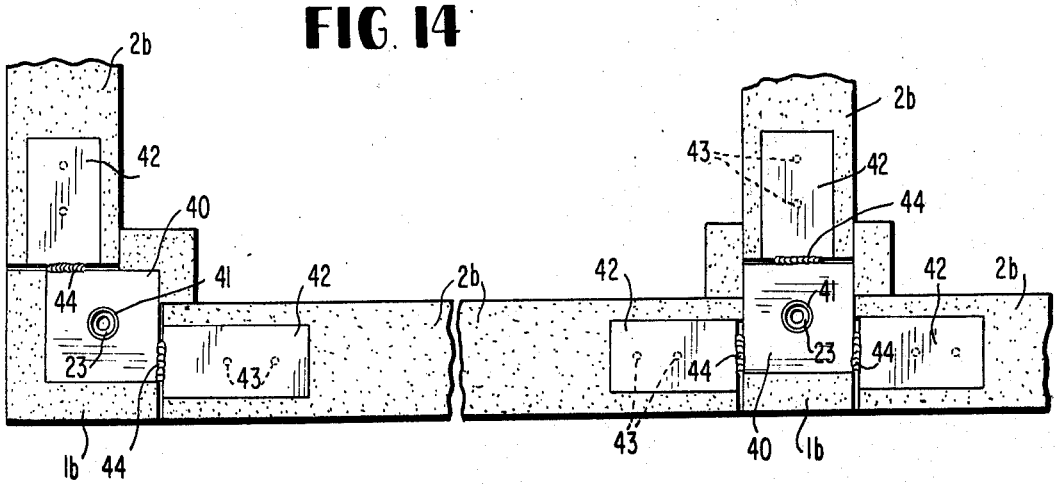
FIG. 14 is a top plan view thereof.

A further modification is shown in FIGS. 13 and 14, wherein upright reinforced columns are shown at 1*b* connected with beams 2*b* of prestressed concrete. Each of the upright columns 1*b* has a support plate 40 over the end thereof which is held in place during the onsite pouring of concrete in the cavity 19 by a coupling 41 screwed over the threaded portion 25 of the sleeve 23. The coupling 41 can be adjusted to the proper height so as to locate the plate 40 in a position to be flush with the upper end of the formed structure and in horizontal alignment with a metal plate 42 which is secured to the upper face of the horizontal prestressed beam 2*b* at the adjacent end of the latter.

The plate 42 can be anchored in the beam 2*b* by suitable anchor bolts 43. It is desirable to secure the plates 40 and 42 in horizontal alignment as, for example, by welding these together, as indicated at 44.

Prestressed concrete beams do not contain reinforcing rods. Therefore, the joining of prestressed beams to reinforced posts or columns should be strengthened by the use of steel welding plates, as illustrated, for example, at 40 and 42, which can be welded or otherwise secured together in a fabricated structure to hold the posts and beams in place during the onsite pouring of the concrete.

At the same time, this construction provides for the supporting of the superposed posts or columns on the rod 28 that is inserted in the aligned sleeves molded in the respective ends of the columns or posts at the top and bottom ends thereof respectively.

This method of construction can also be used in the erection of other types of concrete structures than building as, for example, bridges, ramps and the like. It enables the cost of the concrete to be lowered appreciably and the amount of time required for the completion of the framework likewise will be reduced to a substantial extent inasmuch as only about 5% of the concrete will be poured at the job site, with the remaining 95% of the structure being formed off the job site by means of reusable forms, where appropriate curing can be had.

The forms used to encase the concrete poured at the job site are designed so that they will not only hold the posts and beams in place while the concrete hardens, but will also assist in plumbing the posts and leveling and aligning the beams. This reduces the time needed for the construction and it also reduces the number of skilled workmen required at the job site inasmuch as the posts and beams can be formed off the job site by unskilled labor.

The method and apparatus described facilitate concrete construction in that it provides for:

1. Aligning of posts with these below.
2. Supporting of posts while joining concrete hardens.
3. Holding of posts in a plumb position while joining concrete hardens.
4. Aligning of beams prior to joining to posts and other beams.
5. Leveling of beams prior to joining with posts and other beams.
6. Supporting of beams while joining concrete hardens.
7. Elimination of forming for the pouring of concrete floors by the use of L-shaped beams on the outer edges of each floor.

While the invention has been illustrated and described in certain embodiments, it is recognized that variations and changes may be made therein without departing from the invention set forth in the claims.

I claim:

1. A concrete pouring form for erecting building units comprising opposite upright wall sections and a depending skirt section on each wall section cooperating to form a skirt forming an upright sleeve for embracing an upright post, means for securing the wall sections and skirt sections together, said wall sections extending horizontally in parallel spaced relation from one side of the depending skirt and projecting outwardly therefrom for receiving a horizontal beam, and a shelf support projecting outwardly from the periphery of the upright sleeve between said parallel wall sections at the lower edge portions thereof and at least throughout the length thereof and cooperating therewith to form a horizontal sleeve for supporting the horizontal beam.

2. A concrete pouring form according to claim 1 including a second horizontal sleeve extending in a different direction from the first-mentioned horizontal sleeve for supporting an adjacent end of a second horizontal beam.

3. A concrete pouring form according to claim 2 wherein said wall section and said skirt section are detachable from each other, and means for detachably securing said sections together.

4. A concrete pouring form, according to claim 1, including an ear on the form for attachment of a guy support thereto.

5. A concrete pouring form for erecting building units comprising an upright sleeve for embracing an upright post with horizontal sleeves located above the upper end of the upright sleeve for embracing horizontal beams, said upright sleeve having opposed upper wall sections each with a depending lower wall portion forming a side wall of the upright sleeve and the upper wall sections forming sides of the horizontal sleeves, said horizontal sleeves extending transversely outwardly in different directions from the periphery of the upright sleeve, each horizontal sleeve having a shelf support between the upper wall sections and extending outwardly from the periphery of the upper end of the upright sleeve for supporting ends of horizontal beams.

* * * * *